United States Patent [19]

Kaulfuss

[11] Patent Number: 4,649,647

[45] Date of Patent: Mar. 17, 1987

[54] HAND CUTTING TOOL

[76] Inventor: Herbert E. Kaulfuss, P.O. Box 14242, Raleigh, N.C. 27620

[21] Appl. No.: 789,420

[22] Filed: Oct. 21, 1985

[51] Int. Cl.[4] ..... B26B 29/00

[52] U.S. Cl. ..... 30/293; 30/294

[58] Field of Search ..... 30/286–294, 30/478–489

[56] References Cited

U.S. PATENT DOCUMENTS

| | | | |
|---|---|---|---|
| 915,746 | 3/1909 | Delsee | 30/478 X |
| 1,589,156 | 6/1926 | Hartman . | |
| 1,915,636 | 6/1933 | Wendelken . | |
| 1,956,275 | 4/1934 | Cook . | |
| 2,059,317 | 11/1936 | Davis . | |
| 2,833,035 | 5/1958 | Butler . | |
| 3,037,278 | 6/1962 | Genetti . | |
| 3,478,427 | 11/1969 | Tims . | |
| 4,148,142 | 4/1979 | Sullivan et al. | 30/293 |
| 4,443,942 | 4/1984 | Demeter | 30/293 |

*Primary Examiner*—Fred Silverberg
*Assistant Examiner*—Michael D. Folkerts
*Attorney, Agent, or Firm*—Nicholas A. Kees

[57] ABSTRACT

A hand-operated cutting tool for cutting walling materials such as paneling and drywall. The tool has a base with a smooth, flat bottom, similar to a planing tool. Its handle is curved, attaching at at least one end of the base, and extends over the base. A cutting blade is centrally located on the base, and held in place by a blade clamp. The blade clamp is pivotably attached to the base such that the tip of the blade extends through an opening formed for that purpose in the bottom of the base, and the tip is extended and retracted by the pivoting motion of the clamp. The clamp also has attached thereto a lever arm to facilitate the pivoting. The lever arm is biased against an upstanding member which is manufactured such that the lever arm, and thus the blade tip, can assume different positions. The upstanding member has a continuous groove formed therein which winds about the member from top to bottom such that it appears as several grooves which they may correspond to several positions of the lever arm. Additionally, the upstanding member is rotatable so that it can be turned less than a full turn if desired, causing the lever arm to move less than a full step. The lever arm is extended in such a manner that moving the lever arm a full step between appearances of the groove of the upstanding member is possible, effecting a full step change in the cutting depth of the blade.

4 Claims, 6 Drawing Figures

HAND CUTTING TOOL

BACKGROUND OF THE INVENTION

This invention relates to tools for cutting materials such as paneling and drywall, and in particular to hand tools which are used to cut these materials by passing a blade over them several times.

During the 1920s and '30s, the materials used to make interior walls of buildings were generally soft composition (fiber) materials which were less dense and thinner than present-day materials such as paneling and drywall. Those tools disclosed in Wendelken, U.S. Pat. No. 1,915,636 and Cook, U.S. Pat. No. 1,956,275, were specifically suited for those softer materials. The disclosure of Wendelken recites that the material in mind is "wall board of pulp or paper composition," while in Cook it is "fibrous compositions, such as composition board". Thus with the advent of the modern-day walling materials which are much harder, these tools no long functioned properly.

Accompanying the arrival of these harder materials was the more widespread distribution and use of electricity as an energy source, and a corresponding increase in the availability and usefulness of electric cutting tools, such as electric saws and in particular electric jigsaws. During the past decade, however, it has become apparent that the world's energy resources are not inexhaustible, and so the need for improved hand tools to accomplish these tasks as well as others has again increased.

This invention relates to solutions to the problems enumerated above.

SUMMARY OF THE INVENTION

The need for a hand tool for efficiently and easily cutting walling materials of modern hardness having become clear, the invention includes a smooth, flat base which can slide easily over the surface of the material to be cut. A handle which facilitates the movement of the base both toward and away from the operator is fastened to the base. Also fastened to the base pivotably is a blade clamp for holding a cutting blade vertically such that part of the cutting surface of the blade protrudes through a small opening formed for that purpose in the base. To the clamp is attached a lever arm such that as the lever arm is move up and down the blade protrudes more or less through the opening in the base. This lever arm in turn is biased against an upstanding member which is rotatably attached to the base. The upstanding member has a knurled knob at its top and a single groove which winds about the member from top to bottom such that the groove appears at a plurality of places along any one side of the member. The lever arm and groove are sized so that the arm fits into the groove at any one of its appearances. Thus the member acts as an adjusting device for adjusting the amount of the blade protruding through the base opening. The lever arm can be moved from one appearance of the groove to another for large adjustments, whereas if a fine adjustment is desired the member can be turned less than one full turn to move the lever arm a smaller amount.

It is thus an object of the invention to provide a hand tool for cutting walling materials wherein the depth of cut is easily and accurately adjustable.

Another object of the invention is to provide a hand tool for cutting walling materials which is adapted to making cuts in several passes, wherein the depth of cut is easily and quickly adjusted one step deeper with each pass until the material is cut through.

A more specific object of the invention is to provide a hand tool for cutting walling materials wherein the depth of cut is determined by a pivotable upstanding member having a single groove winding about it from top to bottom such that the groove appears more than once along both sides of the member, and having a lever arm biased against the member, so that the position of the lever arm and in turn the depth of cut can be changed by turning the upstanding member or moving the lever arm to a different position on the member.

Other objects and advantages of the invention will become apparent hereinafter.

DESCRIPTION OF THE PREFERRED EMBODIMENT

Figure 1:
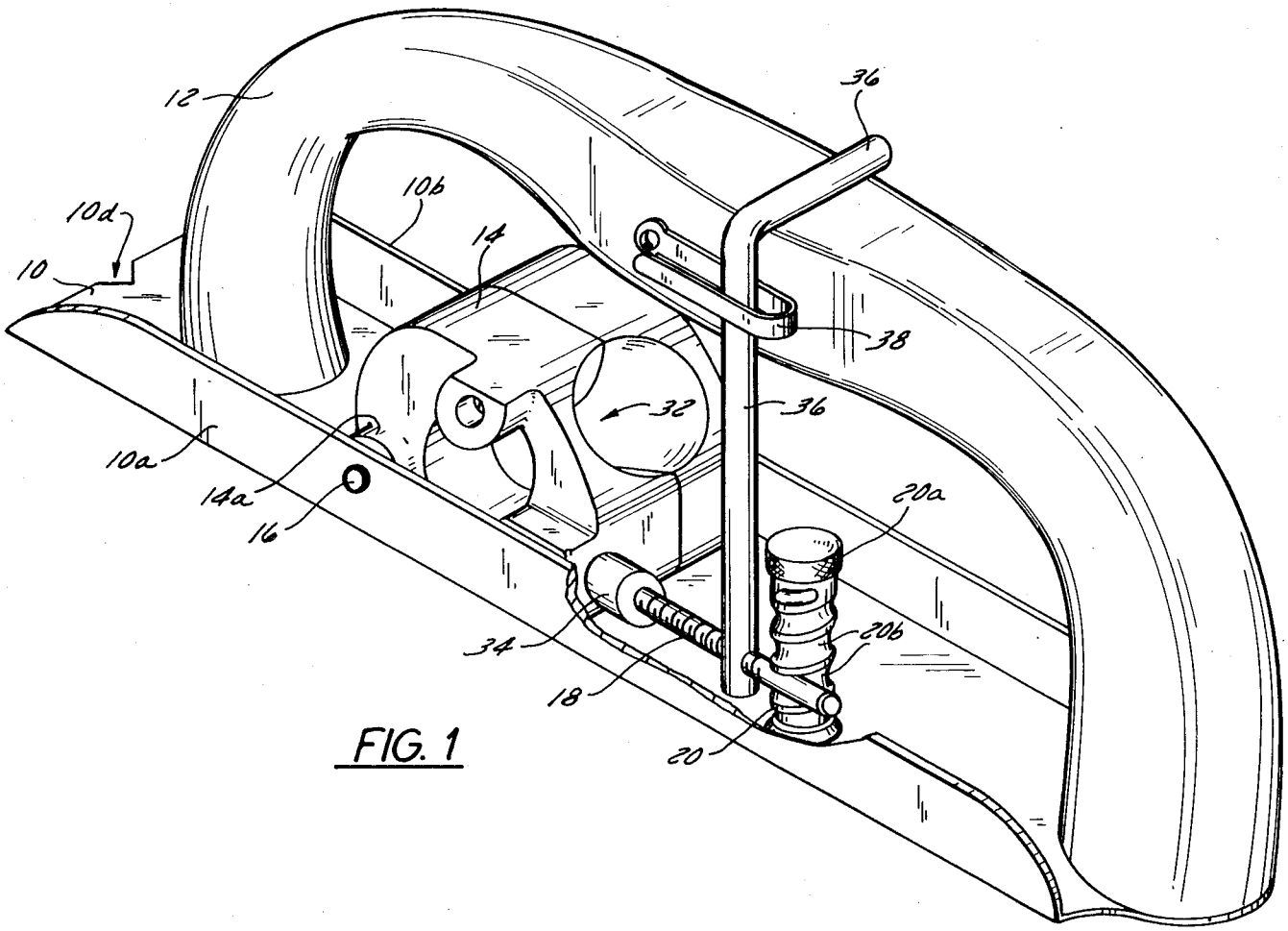
FIG. 1 is an isometric view of a hand cutting tool which includes one embodiment of the invention.

Referring now to FIG. 1, there is shown a base 10 which has a smooth, flat bottom surface, not unlike the bottom surface of a planing tool. A handle 12 is attached to the top surface of the base 10 by any suitable means. Preferably, although not necessarily, the handle 12 is attached at each of its ends to a respective end of base 10 and has a curved shape so that it extends above base 10 between its ends as shown in FIG. 1. A blade clamp 14 is pivotably attached to base 10, by means of a shaft 16 which may be one or more bolts or other suitable shaft-like members. Shaft 16 may be continuous or discontinuous. Shaft 16 passes through raised sides **10*a* and 10*b* of base 10, which are provided for that purpose, and also through a boss 14*a* formed at one end, preferably the front end, that is, the left end as shown in FIG. 1, for that purpose in blade clamp 14. The structure of blade clamp 14** will be explained in more detail below.

To the opposite end of blade clamp 14 is attached a lever arm 18, which preferably protrudes generally horizontally towards the rear (the right of FIG. 1) of the tool. Also near the rear of the tool is placed an upstanding member 20 which is also rotatably attached to base 10. As can be seen in FIG. 1, and in FIG. 3 which is a side view of FIG. 1, upstanding member 20 may have a knurled knob **20*a* at its top. Below knob 20*a* there is formed a continuous groove 20*b* which winds about member 20 from top to bottom similar to a very coarse threading, such as on a bolt. Hence as can be seen best in FIG. 2, the groove 20*b* appears more than once, and preferably three to four times, along the length of any one or more sides of member 20**.

Lever arm 18 is biased against member 20 by its placement in blade clamp 14 with respect to the placement of member 20 in base 10. Lever arm 18 and groove **20*b* are sized so that arm 18 fits snugly in any of the appearances of groove 20***b* along the length of member 20. A second lever arm (not shown) may be located on blade clamp 14 so as to contact member 20 on the side opposite first arm 18, so as to ensure that arm 18 does stay in one of the appearances of groove 20*b* until the operator decides to move it.

Figure 2:
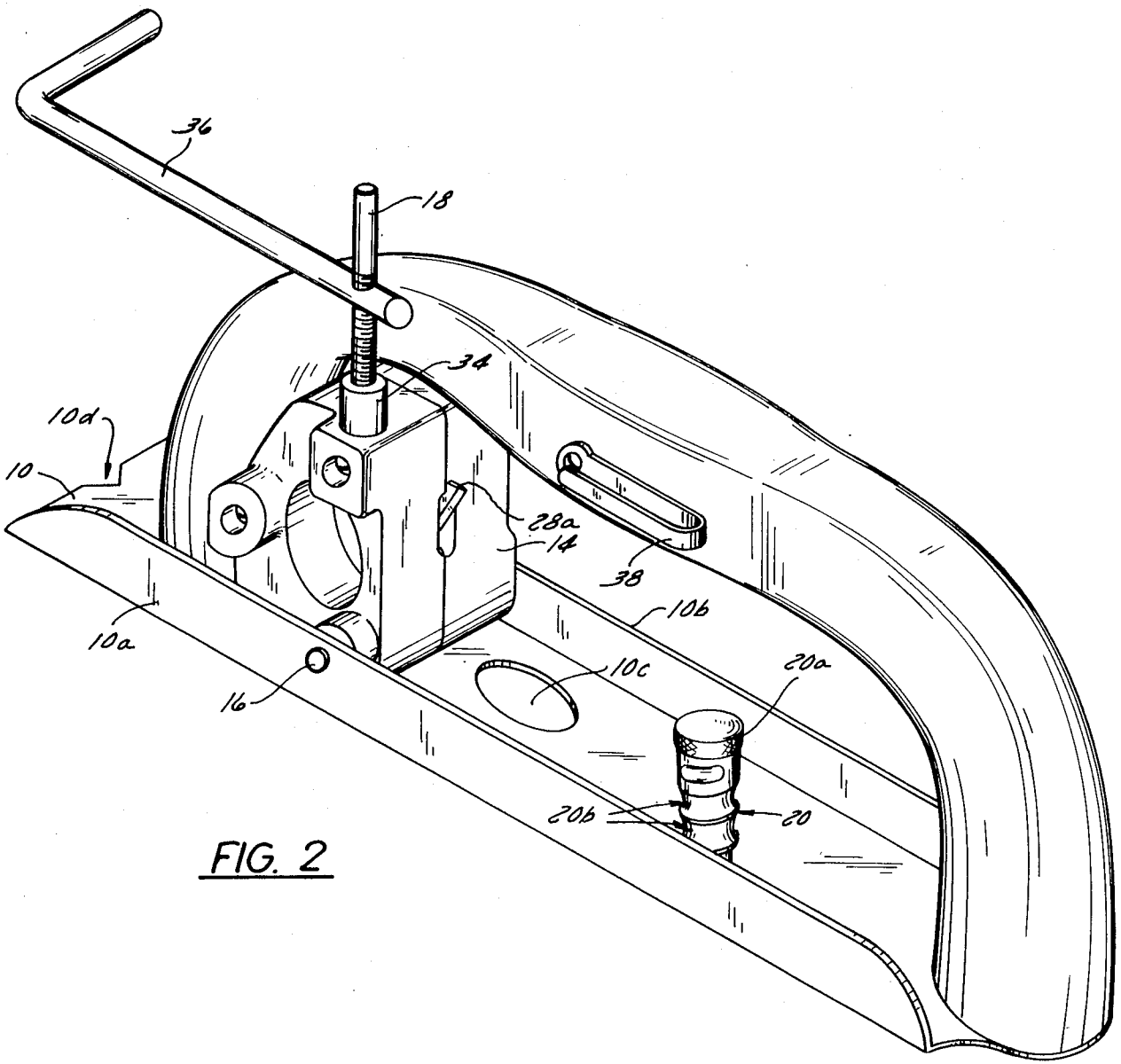
FIG. 2 is an isometric view similar to FIG. 1 showing the lever arm, clamp and cutting device in the raised position.
Figure 3:
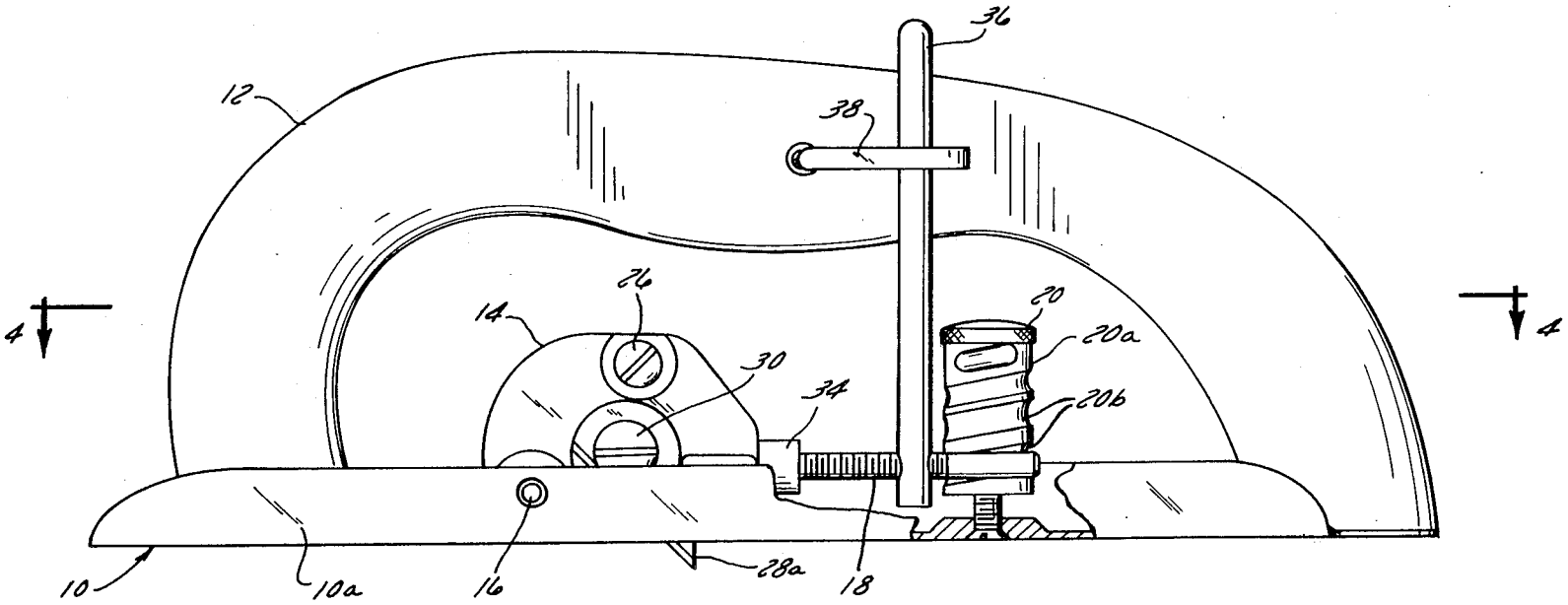
FIG. 3 is a side view of the embodiment shown in FIG. 1.
Figure 4:
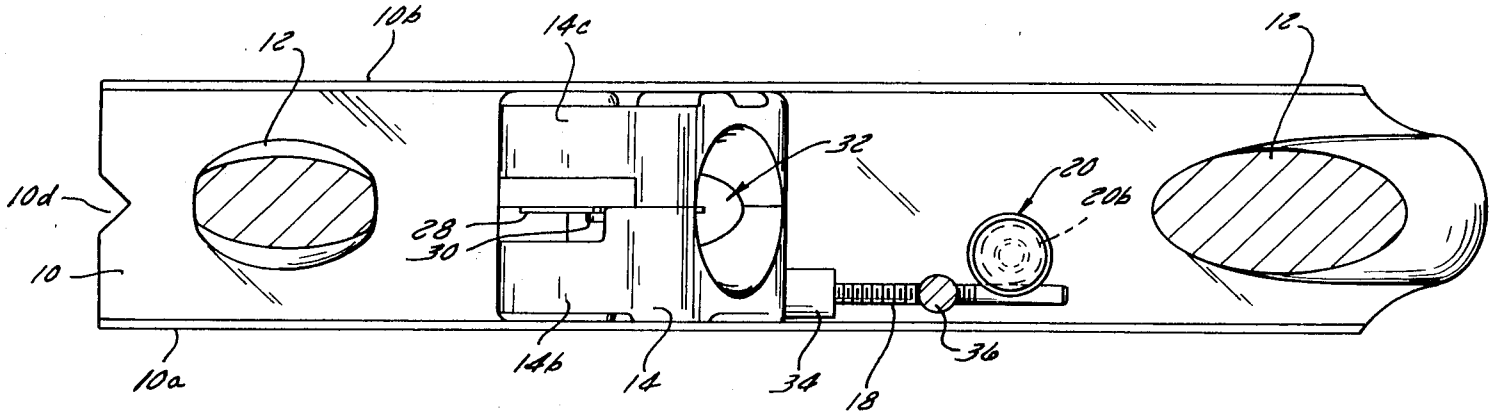
FIG. 4 is a sectional view of the embodiment shown in FIG. 3 taken along line 4—4.
Figure 5:
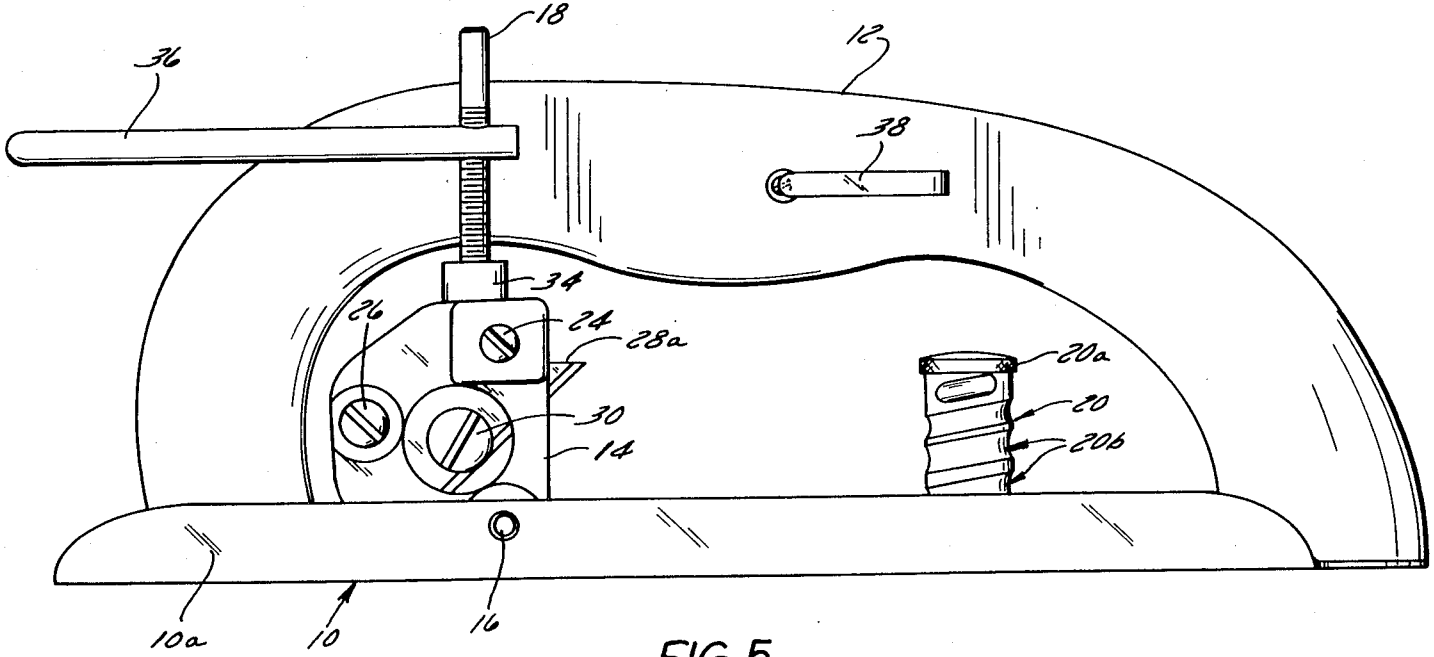
FIG. 5 is a side view of an embodiment of the invention in the position shown in FIG. 2.
Figure 6:
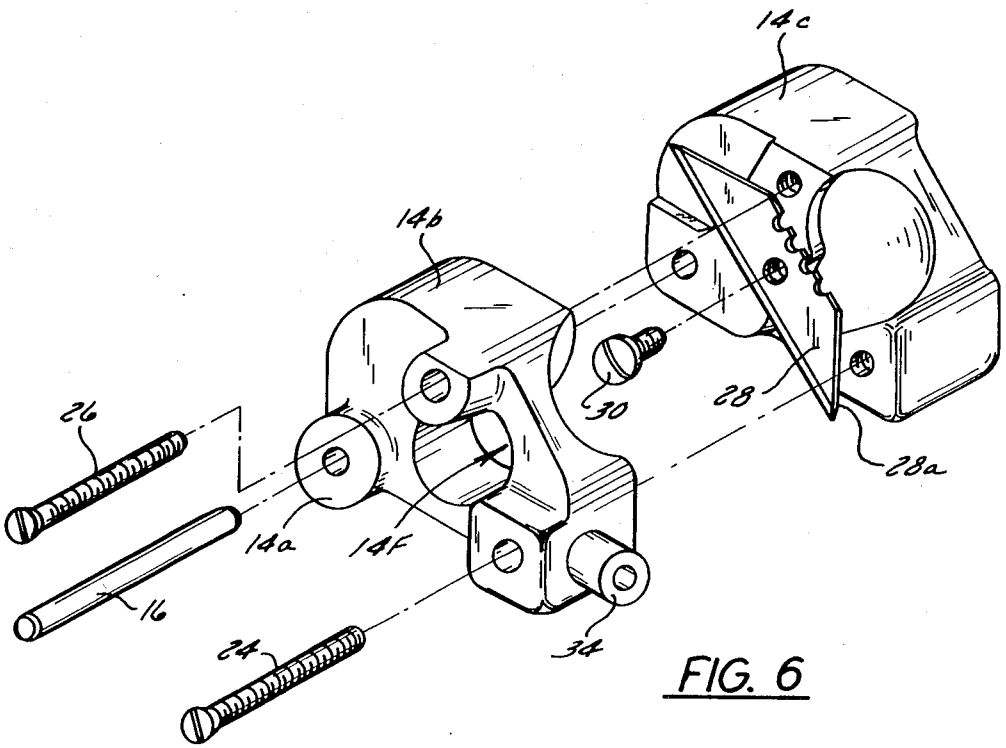
FIG. 6 is an exploded view of the blade clamp assembly shown in the previous figures.

Blade clamp 14 is shown in more detail in FIG. 6, which shows an exploded view of the clamp and its parts. As can be seen by viewing the figure, blade clamp 14 may be provided in two parts, a left block 14*b* and a right block 14*c*. Each is basically a mirror image of the other except for certain minor variances. As described above, both blocks have a boss 14*a* for receiving shaft 16 and allowing clamp 14 to pivot with respect to base 10 (FIG. 1). Left block 14*b* may also have bosses 14*d* and 14*e* for receiving fastening means for fastening the two blocks together. In the preferred embodiment, these fastening means are screws 24 and 26 which may be threaded into corresponding tapped holes in right block 14*c*. A cutting blade 28 is secured to one of the blocks, in FIG. 6 the right block 14*c*, by any suitable removable means such as a screw 30, while the other block, in FIG. 6 the left block 14*b*, is provided with an opening 14*f* sufficiently large to allow removal of the blade screw 30 without disassembly of the entire unit. As can be seen in FIG. 6 as well as in FIGS. 2, 3 and 5, the blade 28 is located with respect to the clamp 14 such that the tip 28*a* extends beyond the edge of the clamp. Further, as shown in the side view of FIG. 3, the blade 28 must also extend through the base 10 so that cutting can be accomplished. As shown in FIG. 2, an opening 10*c* is formed for this purpose in the bottom of base 10, positioned so that blade 28 fits through the opening when the blade clamp 14 is in the down position as shown in FIGS. 1, 3 and 4. Moreover, cutting will be facilitated if blade tip 28*a* is sharpened on both edges, since the utility of the tool in improved if it can cut on both the forward and return passes. In addition, again referring to FIG. 6, each blade clamp block 14*b* and 14*c* also preferably includes a semi-cylindrical opening which, when the two blocks are assembled together, forms a cylindrical opening 32 through the center of clamp 14. The purpose of this opening 32 is to provide an area near the blade 28 for sighting along the line at which the material is to be cut. This aid would be in addition to a notch 10*d* formed at the front center of the base 10, again for sighting purposes. Finally, FIG. 6 also shows the boss 34 which is attached to clamp 14 and into which is secured the lever arm 18.

As shown in FIGS. 1 through 3 and 5, an extension 36 is perpendicularly secured to lever arm 18. This extension 36 extends vertically upward from base 10, as shown best in FIG. 1, terminating in the area of the handle 12. There the extension 36 is held basically against the handle 12 by a bracket 38, when the blade clamp 14 is in the down position. Of course when the blade clamp 14 is in the up position, as shown in FIGS. 2 and 5, such as for disassembly, the extension 36 does not necessarily remain within the confines of bracket 38. The purpose of extension 36 is to facilitate the movement of lever arm 18 with respect to upstanding member 20, without forcing the operator to move his hand from the handle 12. Alternatively lever arm 18 may be formed to integrally include an upstanding portion arranged to fit into bracket 38, similar to extension 36.

The fact that the groove 20*b* is continuous and winds around member 20 such that it appears to present several identical but offset grooves is important to allow the user of the tool to cut materials of different relative hardnesses. A single means is thus provided for moving the blade tip 28*a* either a full step or continuously without steps or in infinitely small steps. Hence for instance if the operator is cutting material such as paneling, the full step from one appearance of the groove 20*b* to another can be taken. If the operator is cutting a relatively hard material, such as drywall or hard board, less than a full step can be taken by turning member 20, such as by means for knob 20*a*, less than a full turn, so that the material is cut by smaller amounts. Additionally a combination of these approaches can be taken where the material to be cut varies in hardness, such as when plywood is cut alternately across and along the grain of the wood, or when a hard veneer covers a softer backing material.

In operation, the operator first of course draws a line on the material to be cut, using a suitable straight-edge. The operator then places the tool such that the line drawn on the material lines up in notch 10*d* of base 10 and with the blade 28 by looking through the opening 32 provided for that purpose. Alternatively any of several edge guides which are commercially available may also be employed to guide the operator. He further sets the blade 28 at the setting which corresponds to the least amount of cut for the first pass. This means that he sets lever arm 18 to the highest appearance of groove 20*b* on upstanding member 20, possibly by use of extension 36. He thereupon uses the tool to pass the blade 28 along the mark on the material once. If the material being cut is soft enough, the next step is to snap the lever arm 18 down to the next appearance of the groove 20*b*, again by use of extension 36, make another pass with the blade tip 28*a* protruding further through opening 10*c*, and continuing to make passes with the blade tip 28*a* protruding one step further on each pass, until the material is cut all the way through. If the material being cut is harder, the blade tip 28*a* is moved down less than a full step by turning member 20 less than a full turn, thus lowering the blade tip 28*a* less than a full step. In this manner, while more passes will be required, the operator can still cut the harder materials using this tool in a succession of passes.

While the apparatus hereinbefore described is effectively adapted to fulfill the aforesaid objects, it is to be understood that the invention is not limited to the disclosed embodiments of hand cutting tool. Rather the invention is to be taken as including all reasonable equivalents without departing from the scope of the appended claims.

What is claimed is:

1. A hand-operated cutting tool, for cutting materials using several passes of the tool, comprising:

a base, having a flat bottom;

a handle attached to said base, by which the operator holds the tool;

clamp means pivotably attached to said base;

a cutting blade secured by said clamp means, such that the tip of said blade protrudes through an opening in said base;

means for pivoting said clamp means both in steps and continuously for correspondingly adjusting the depth of cut of said blade both in steps and continuously, said pivoting means comprising:

a lever arm attached to said clamp; and an upstanding member rotatably attached to said base, having a groove which winds about said member continuously from top to bottom such that it appears several times along the length of the member, and such that said lever arm can be selectively disengaged from any one of the appearances of the groove and engaged in an adjacent appearance, the particular appearance of the groove selected determining the depth of cut of said blade, and in addition the upstanding member can be turned to adjust the depth of cut in smaller increments.

2. A cutting tool as recited in claim 1 further comprising means for effectuating said pivoting without the necessity of the operator removing his hand from the handle.

3. A cutting tool as recited in claim 2 wherein said effectuating means includes an extension which attaches to said lever arm and terminates near said handle such that said lever arm can be moved along said upstanding member without requiring the operator to remove his hand from the handle.

4. A cutting tool as recited in claim 2 wherein said effectuating means includes an extension formed integrally with said lever arm terminating near said handle such that said lever arm can be moved along said upstanding member without requiring the operator to remove his hand from the handle.

* * * * *